United States Patent [19]

Brandon et al.

[11] 4,085,485

[45] Apr. 25, 1978

[54] PROCESS AND DEVICE FOR FORMING NON-WOVEN FABRICS

[75] Inventors: Ralph E. Brandon, Monroe; Michael Ring, Warwick; Raymond Redner, III., Newburgh, all of N.Y.

[73] Assignee: International Paper Company, New York, N.Y.

[21] Appl. No.: 708,537

[22] Filed: Jul. 26, 1976

[51] Int. Cl.[2] ..... D04H 1/46

[52] U.S. Cl. ..... 28/104

[58] Field of Search ..... 19/161 P; 28/4 R, 72.2 F, 28/104, 105; 427/420

[56] References Cited

U.S. PATENT DOCUMENTS

| | | | |
|---|---|---|---|
| 665,868 | 1/1901 | Briggs | 162/297 |
| 1,140,601 | 5/1915 | Lappen | 162/297 |
| 1,248,565 | 12/1917 | Slattery | 239/556 |
| 1,454,376 | 5/1923 | Gentile | 118/44 |
| 1,989,435 | 1/1935 | Wallquist | 92/38 |
| 2,139,628 | 12/1938 | Terry | 91/18 |
| 2,665,615 | 1/1954 | Niks | 92/44 |
| 2,680,079 | 6/1954 | Huebner | 427/47 |
| 2,862,251 | 12/1958 | Kalwaites | 19/161 P |
| 2,921,748 | 1/1960 | Kane | 239/534 |
| 2,940,418 | 6/1960 | Penrod et al. | 118/63 |
| 2,969,190 | 1/1961 | Foreman | 239/597 |
| 3,075,579 | 1/1963 | Winterburn | 162/310 |
| 3,081,951 | 3/1963 | Dyer et al. | 239/455 |
| 3,303,816 | 2/1967 | Lauring | 118/DIG. 5 |
| 3,341,354 | 9/1967 | Woods et al. | 427/288 |
| 3,392,919 | 7/1968 | Knife | 239/455 |
| 3,436,022 | 4/1969 | Ernst | 239/455 |
| 3,485,706 | 12/1969 | Evans | 28/72.2 F |
| 3,493,462 | 2/1970 | Bunting et al. | 28/72.2 F |
| 3,613,999 | 10/1971 | Bentley | 239/53.3 |
| 3,839,148 | 10/1974 | Beck | 162/310 |

*Primary Examiner*—Louis K. Rimrodt
*Attorney, Agent, or Firm*—Ronald A. Schapira

[57] ABSTRACT

A process and device useful therein for hydraulically entangling the fibers in a fiber batt to form a non-woven fabric. The process includes applying at least one liquid curtain against the fiber batt while it is supported on a moving, apertured backing screen. The liquid curtain is uniform in width throughout its length and substantially non-diverging as it is delivered from a source of liquid under a pressure sufficient to effect entanglement of the fibers in the batt. Preferably, the pressure is at least about 200 p.s.i.g. and the maximum divergence of the curtain is about 4 degrees. The device for applying the liquid curtain includes first and second members and means for securing the members together to form a chamber therebetween in which the liquid is contained and to form a slot in communication from the chamber to the exterior of the device. The slot has a substantially uniform width along its length and preferably also a uniform depth. The securing means are adjustable so that the width of the slot can be varied; however, once the members are secured together the width of the slot remains constant as the curtain is delivered from the chamber, through the slot, and against the fiber batt.

27 Claims, 20 Drawing Figures

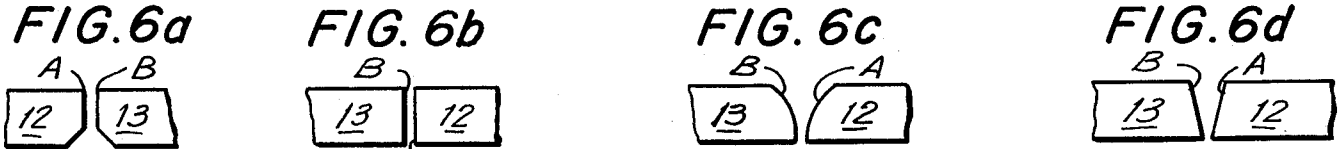
FIG. 6a
A
B
12
13
FIG. 6b
B
A
13
12
FIG. 6c
B
A
13
12
FIG. 6d
B
A
13
12
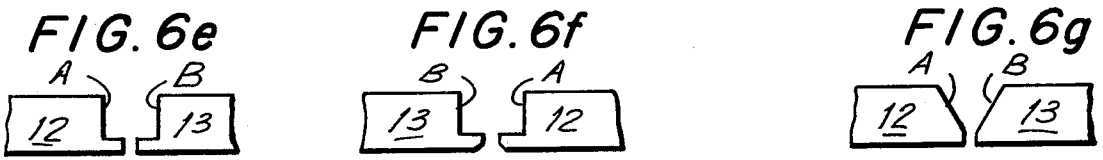
FIG. 6e
A
B
12
13
FIG. 6f
B
A
13
12
FIG. 6g
A
B
12
13

PROCESS AND DEVICE FOR FORMING NON-WOVEN FABRICS

BACKGROUND OF THE INVENTION

The invention relates to a process and a device useful therein for hydraulically entangling the fibers in a fiber batt to form a non-woven fabric. More particularly, it relates to a process utilizing a device having a slot defined therein through which a curtain of liquid is applied against the fiber batt. The curtain is substantially non-diverging and uniform in width throughout the length of the slot when applied under a pressure sufficient to cause fiber entanglement.

It has been known in the past to form loosely interconnected fiber batts by wet, dry, and air lay techniques. To form a permanently bonded, non-woven fabric, the fibers of the batt must be permanently connected together. Generally, the two methods have been utilized to hold the individual fibers together so that they form an integrated web of permanently associated fibers. First, a fiber web having strength and coherency may be produced from the batt by the application of an adhesive or bonding agent at selected points of interconnection of the fibers. The strength which can be achieved by such a method and the utility of the bonded web obtained are limited by the bonding strength of the agent utilized and its ability to maintain its bonding strength during the normal usage of the fabric manufactured. However in many applications the presence of an adhesive agent is undesirable, particularly when used in the amount required to alone hold the fibers of the web together, because of the deleterious effect on the final characteristics of the fabric manufactured.

A second method, which has been utilized to permanently interconnect the fibers of the batt to form a coherent web, involves mechanically entangling the fibers by (1) conventional needle looming and (2) the application of liquid forces against the batt to permanently entangle the fibers. Mechanical needling using a loom is well known to those skilled in the art. Hydraulic entangling methods generally include passing a layer of fibrous material on a suitable support under a plurality of individual high pressure liquid streams. Although the strength and coherency of the fabric web formed using this method may be satisfactory, it has been found that the individual liquid streams cause streaking or non-uniform fiber entanglement across the layer of fibrous material, i.e. in those areas of the material not contacted by the liquid streams. By the use of a hydraulic curtain in accordance with the preferred method of using this invention, this problem is avoided.

Devices are known which produce a curtain of liquid for the purpose of application against a layer of fibers in a slurry. However, these devices appear to be used for the rearrangement of the fibers in the batt and not their entanglement, in accordance with the objectives of this invention. For example, when the liquid curtain of the present invention is used to entangle the fibers in a batt into a coherent fabric web, the curtain is applied under a pressure sufficient to cause entanglement rather than just rearrangement of the fibers. The curtain is substantially non-diverging and uniform in width throughout its length, which results in uniform fiber entanglement. When the methods and devices of the prior art are utilized at a pressure sufficient to effect fiber entanglement, a substantially non-diverging, liquid curtain of a uniform width will not be obtained because no adequate means are provided for obtaining such a uniform width, non-divergent curtain.

Thus, the present invention may be utilized to avoid streaking or uneven fiber entanglement. Also, uniform entanglement may be achieved because a uniform width, substantially non-diverging curtain can be produced according to this invention under a pressure sufficient to effect fiber entanglement. Another advantage of the present invention is that by utilizing a slot formed between two members secured together, a uniform width non-divergent curtain of liquid is more readily obtained than if the slot is formed by a cut made through a single member. It has been found to be difficult to cut a very narrow slot through a single member so that the surfaces defining the slot are even. Practically, the machining of the slot cannot be accomplished to result in a very thin slot having smooth faces. By initially making individual members and then securing the members together as in the present invention, unevenness of the slot defining surfaces of the members is no problem.

In addition to the advantage of the device of the present invention that it is capable of producing a substantially non-diverging, uniform width liquid curtain, means for varying the width of the curtain are also provided. Thus, the same device may be utilized to produce curtains of different widths without the necessity for complicated restructuring of the device for this purpose or for storing of several devices that each produce a curtain of a specific width. Another advantage of the device of the present invention is that it produces a liquid curtain whose width and divergence are essentially independent of liquid pressures over a wide range. Another advantage of the device is that, if one desires, the device surfaces defining the slot can be machined to have a profile (other than being flat through their length) which provides various desired characteristics of the curtain to be obtained without increase of the divergence of the curtain.

SUMMARY OF THE INVENTION

In accordance with the present invention, a device for applying a liquid curtain against a batt of fibers to entangle the fibers is provided. The device comprises a first member having a recessed portion defining at least a major portion of a longitudinal chamber adapted to contain a liquid delivered therein from a liquid source under a pressure sufficient to effect fiber entanglement upon application of the liquid from the device against the fiber batt. The first member further has an integral first machined surface extending essentially parallel to and substantially the length of the chamber. The device further comprises a second member having a second machined surface extending substantially along its entire length. The second member conforms to an open portion of the first member to form with the first member the chamber and a slot in communication from the chamber to the exterior of the device. The device further comprises means for securing the members together so that the machined surfaces define the slot and the slot has a uniform width along the length of the chamber and the machined surfaces essentially rigid, whereby a substantially non-diverging, curtain of liquid of a substantially uniform width may be delivered through the slot for application against the batt of fibers.

In accordance with the present invention, the batt of fibers is supported on an apertured backing screen, which screen is in a movable relation with the device and liquid being delivered therefrom. Preferably, more than one device will be utilized; thus, depending on the degree of entanglement desired, devices may be placed above and/or below the batt of fibers. Preferably, the angle of incidence of each device to the batt is about 90°. Further, the pressure under which the liquid is contained in each device being utilized may vary to further effect the degree of entanglement of the fibers in the batt.

Further, in accordance with the invention, a process for entangling the fibers in the fiber batt comprises supporting the batt on the apertured backing screen and applying at least one liquid curtain against the batt, while the batt and backing screen are in a movable relation with the curtain. The curtain is substantially uniform in width throughout its length and substantially non-diverging as it is delivered from a source of liquid under pressure to cause entanglement of the fibers in the batt. Preferably, the curtain will have a maximum divergence of about 4 degrees when it is applied against the batt under a pressure of not less than about 200 p.s.i.g. which gives a jet velocity of about 192 ft/sec.

Figure 7:
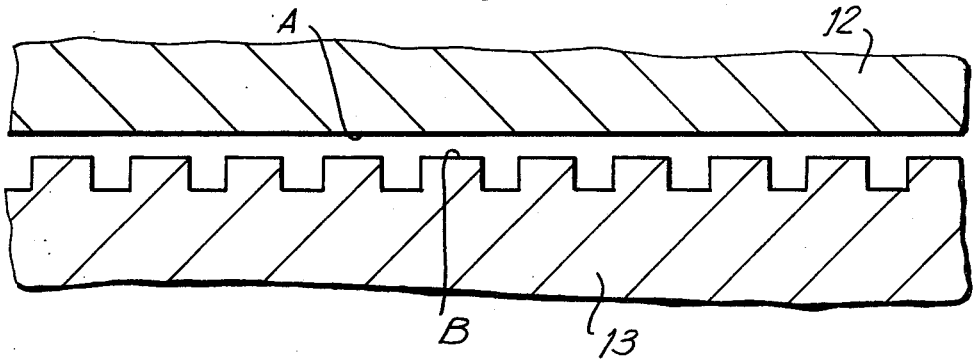
Figure 8:
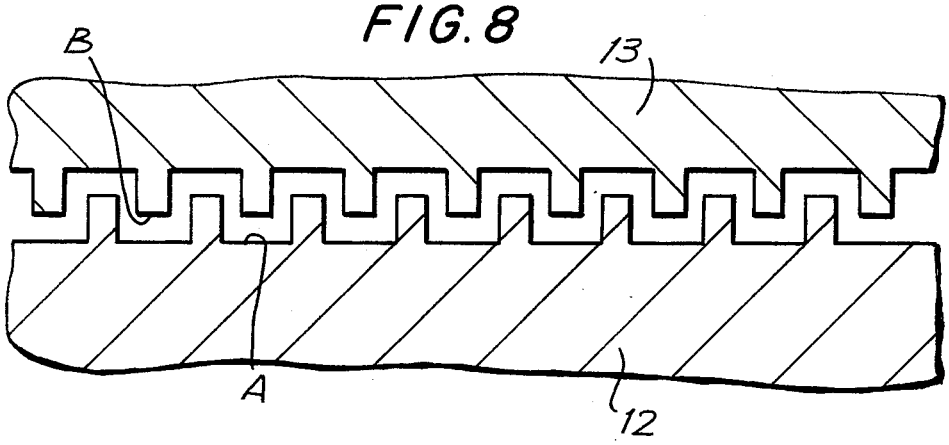
Figure 9:
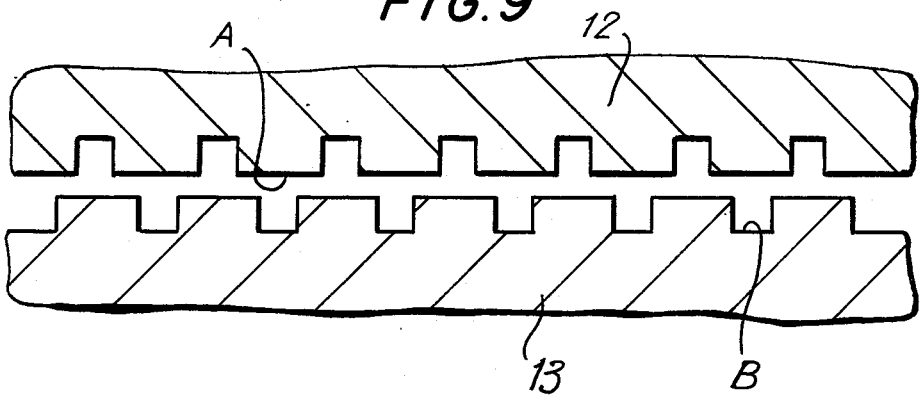

FIGS. *6a–6g* schematically illustrate in various side views slot profiles useful in the device of the present invention;

FIGS. 7–9 are top views of additional slot profiles similar to those illustrated in FIGS. *6a–6g;*

Figure 10:
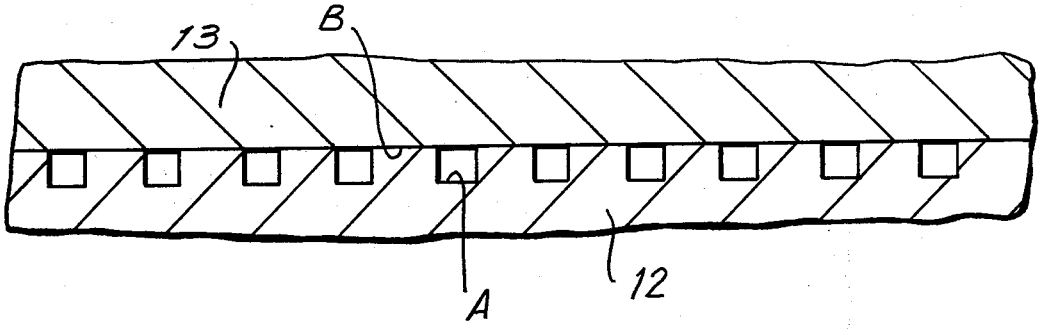
Figure 11:
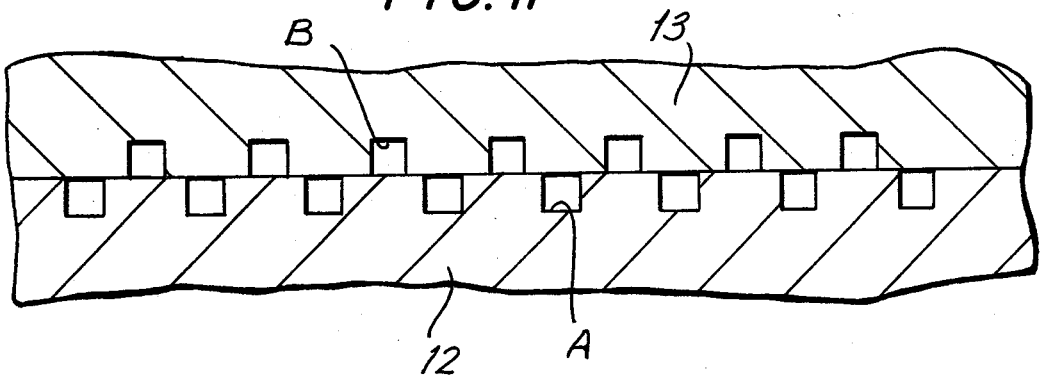
Figure 12:
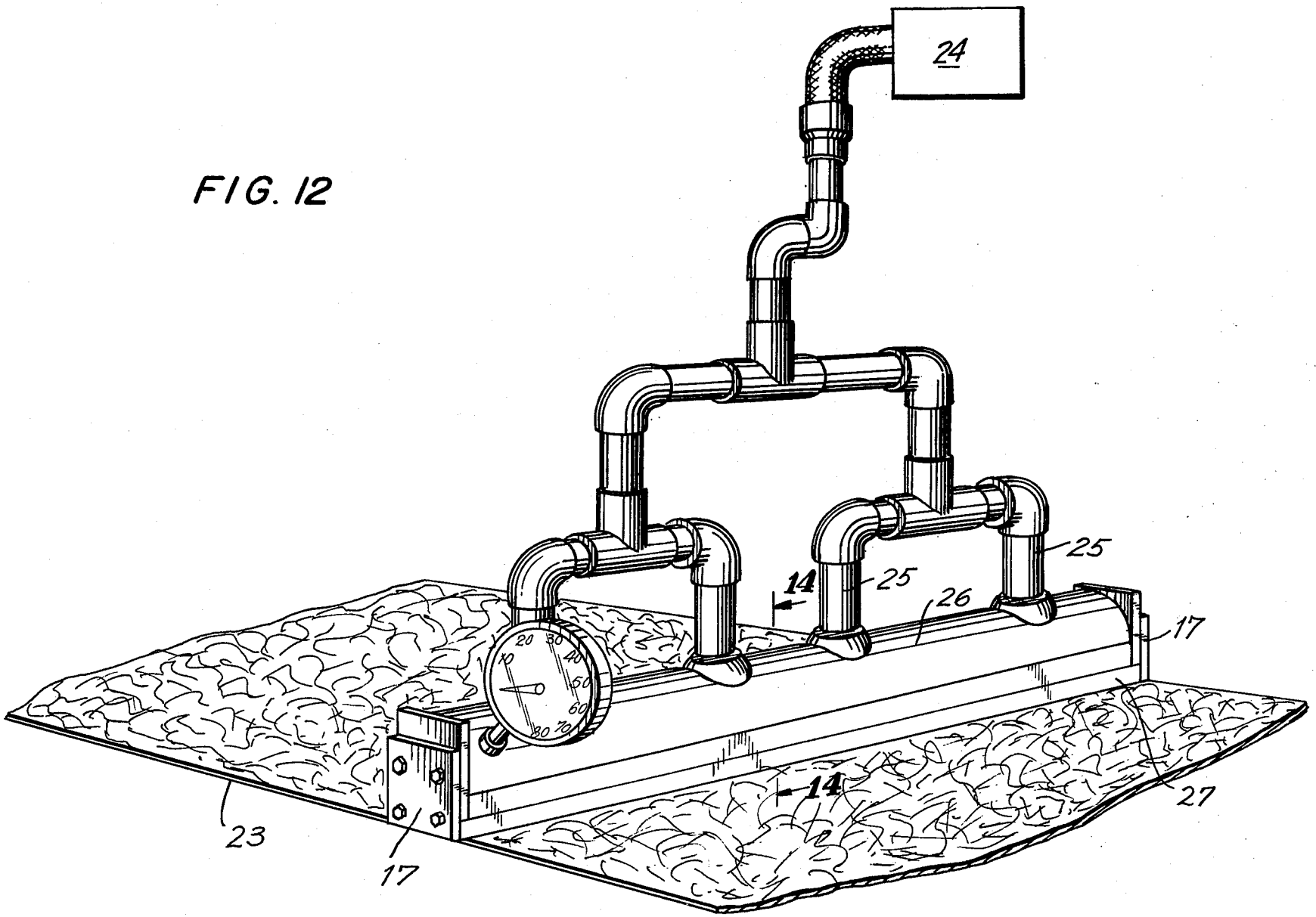
Figure 14:
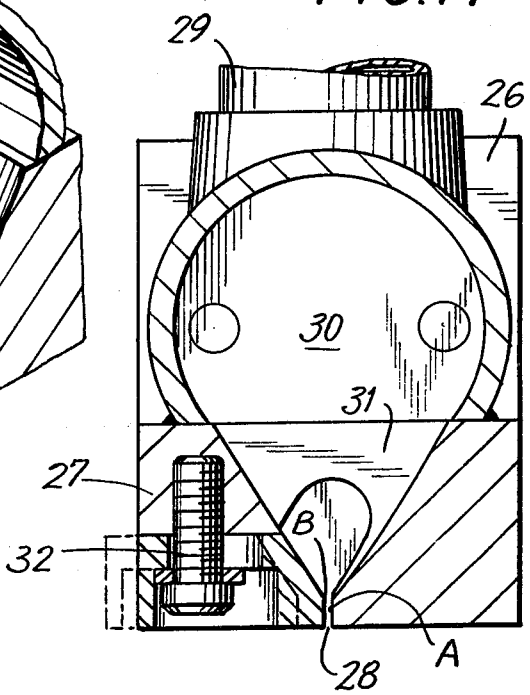
Figure 13:
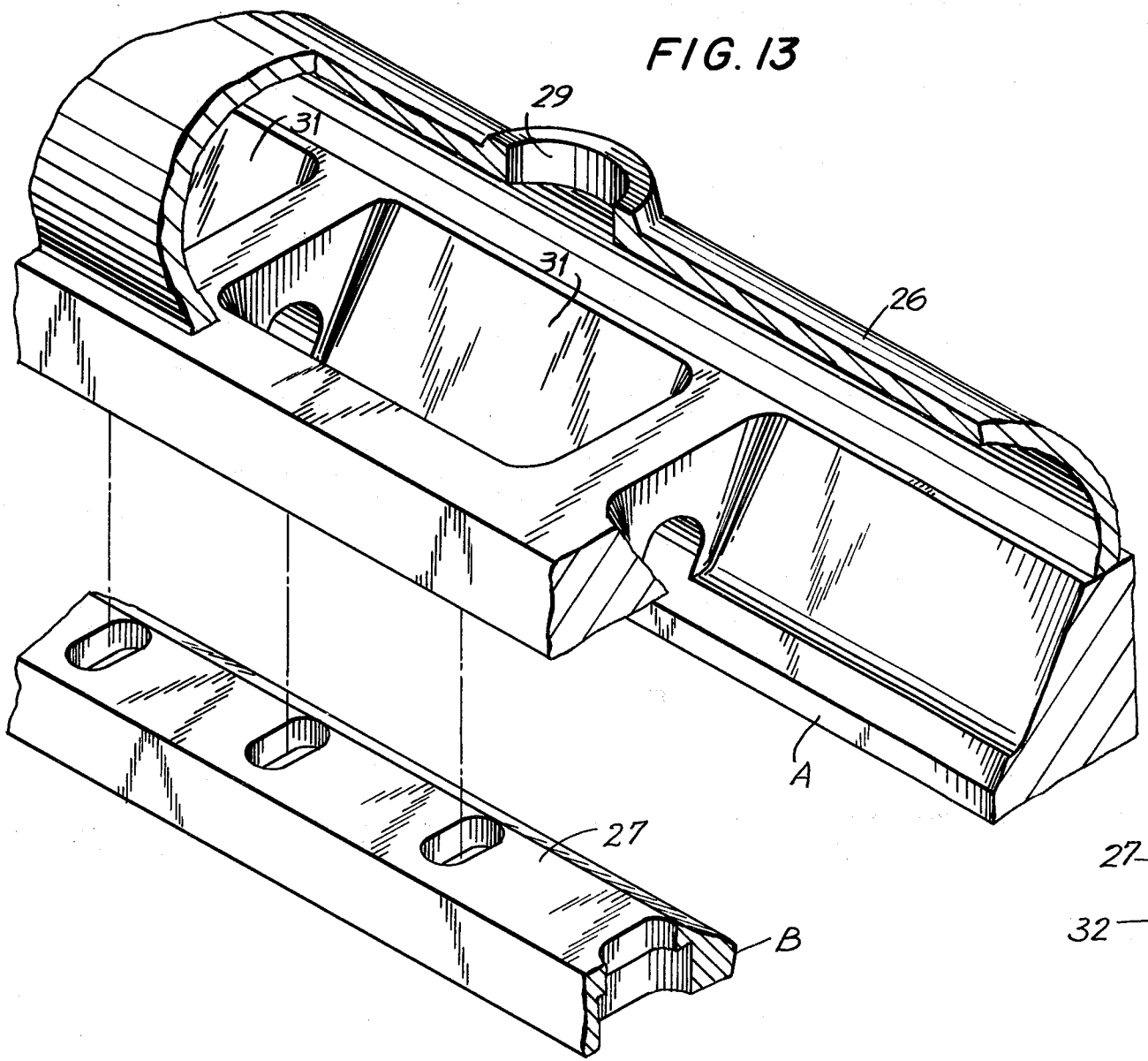

FIGS. 10 and 11 are top views of modifications of the slot profiles shown in FIGS. 7 and 9;

FIG. 12 is a perspective view of another embodiment of the device of the present invention showing this device in place over a batt of loosely interconnected fibers supported on a movable, apertured backing screen (partially shown);

FIG. 13 is a perspective view, partially cutaway, of portions of the device illustrated in FIG. 12 in which the components of the device are illustrated prior to their being assembled; and FIG. 14 is a cross sectional view of the device illustrated in FIG. 12 taken along lines 14—14 of FIG. 12 showing a slot formed of minimum width in solid line and a maximum width in dotted line in the device.

DETAILED DESCRIPTION OF THE PREFERRED EMBODIMENTS

The fiber entangling process and device of the present invention are useful in making a non-woven fabric from a fiber batt consisting of staple fibers. The fibers to be entangled may be, for example, fibers ½ inch or longer and 1,25 denier or heavier. The invention is particularly useful for making non-woven fabrics from relatively long and thin, flexible fibers having a length to diameter ratio of about 1000 to about 3000, such as polyester fibers of ½ to 1½ inches in length and 1.25 to 3.0 denier.

Figure 1:
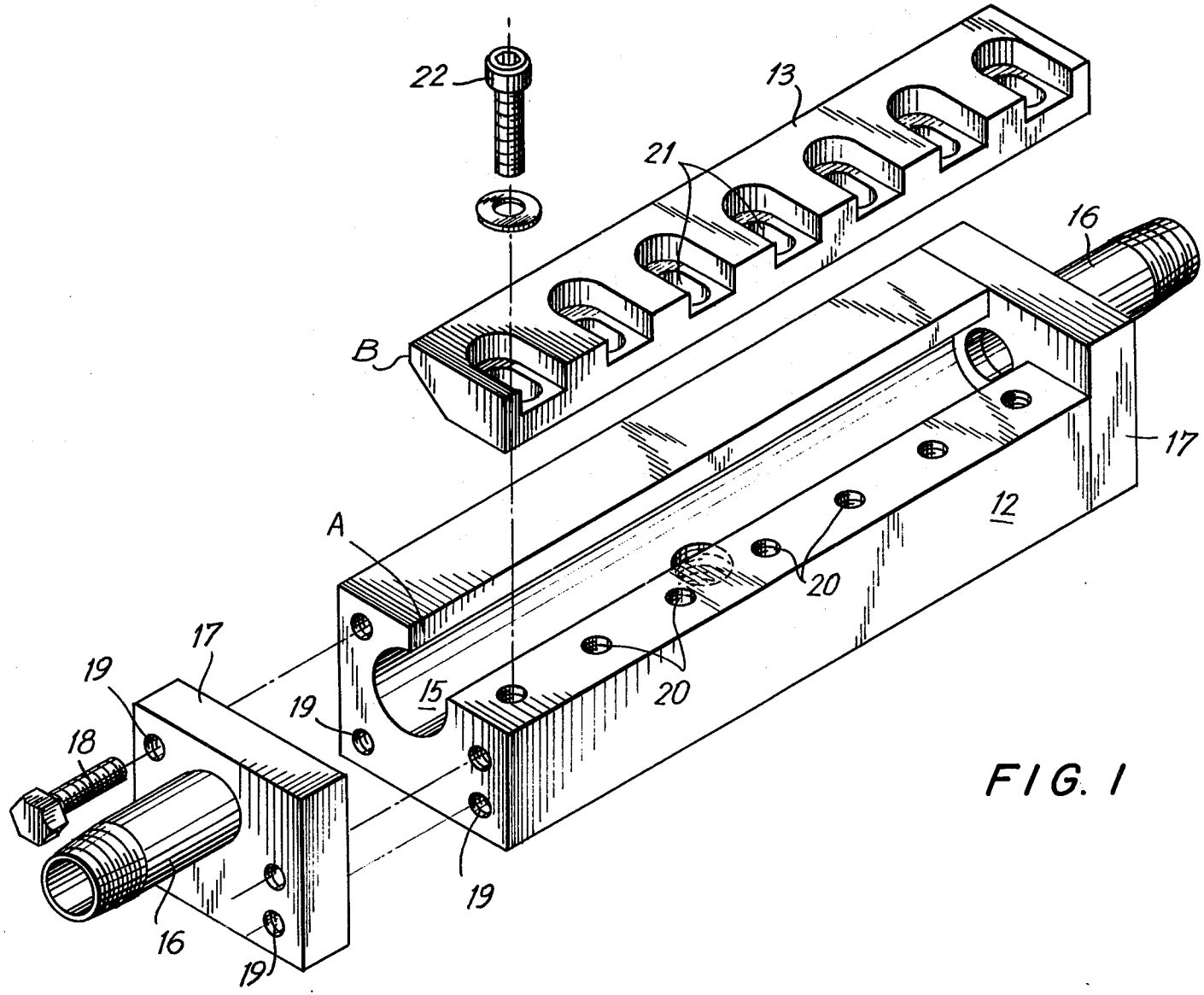
FIG. 1 is a perspective view of an embodiment of the device of the present invention in which the components of the device are illustrated prior to being assembled.
Figure 2:
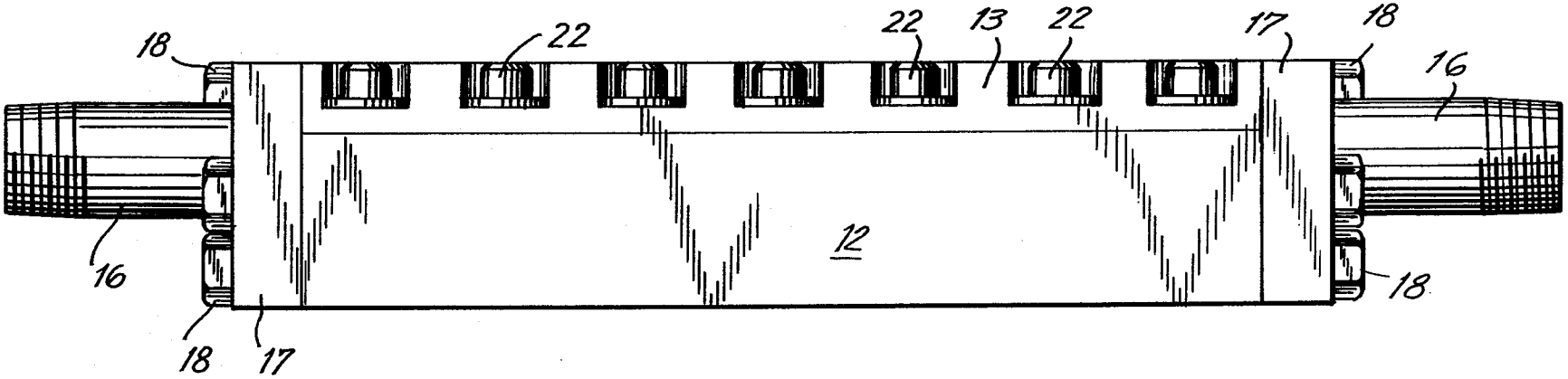
FIG. 2 is a side view of the device illustrated in FIG. 1 in which the components of the device have been assembled.
Figure 3:
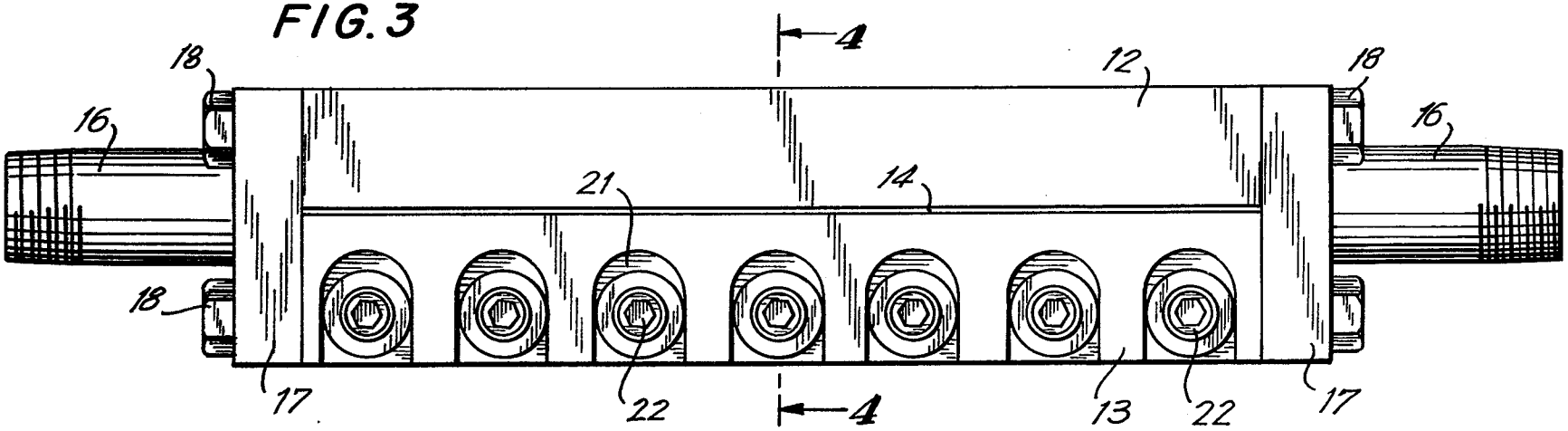
FIG. 3 is a top view of the assembled device illustrated in FIG. 2.

An embodiment of the device of the present invention is illustrated in FIGS. 1–5. The device includes a first member or body portion 12, a second member or slot adjuster 13, and means for securing these members together to define a slot therebetween. In FIG. 1, body portion 12 and slot adjuster 13 are illustrated prior to their being secured together as in FIGS. 2 and 3, after their being secured together to define a slot 14 shown in FIG. 3. Body portion 12 has a recessed portion defining at least a major portion of a chamber 15 adapted to contain a liquid delivered therein from a liquid supply source. Means for delivering the liquid, which is under pressure, into chamber 15 are preferably in communication with chamber 15 through the ends of body portion 12, but it is contemplated that liquid may also be delivered into the device through other portions of body portion 12. Preferably the liquid delivery means are pipes 16. Although pipes 16 may be secured onto portion 12 by any of several conventional means, such as by the mating of threads on each of these structures, end caps 17 and bolts 18 are provided for this purpose. Pipes 16 are welded to openings in end caps 17 and then caps 17 are secured to body portion 12. Preferably matching threaded openings 19 are provided in portion 12 and caps 17 for receiving bolts 18, as illustrated in FIG. 1.

Slot adjuster 13 is best illustrated in FIG. 1. It is generally an elongate member adapted to conform to the open portion of body member 12 over which it is shown in this drawing thereby forming with body member 12 the chamber 15 and slot 14, Thus, slot 14 is in communication with chamber 15 and the exterior of the device.

Several conventional means are contemplated for securing body portion 12 together with slot adjuster 13 to form slot 14, but it is preferred that the means selected allow the width of slot 14 to be varied easily, avoiding extensive mechanical disassembly of the device to accomplish this objective, and insure that slot 14 has a uniform width along the entire length of chamber 15. The means preferred are threaded openings 20 in body portion 12, openings 21 in slot adjuster 13, and bolts 22, which can be inserted through openings 20 and 21 to adjustably secure these members together.

Openings 20 are made through the top surface of body portion 12 in the area of this structure onto which slot adjuster 13 is to be placed. Openings 21 extend through slot adjuster 13 to accommodate bolts 22, which will pass therethrough into openings 20 when slot adjuster 13 is secured onto body portion 12. It is apparent from FIG. 1, that openings 21 are larger or have a greater transverse length than the diameter of bolts 22, so that slot adjuster 13 can be secured at various positions on body portion 12 to provide a slot 14 of varying width. Preferably, openings 20 and 21 can be threaded to mate with threads on bolts 22 to secure portion 12 to adjuster 13.

Figure 5:
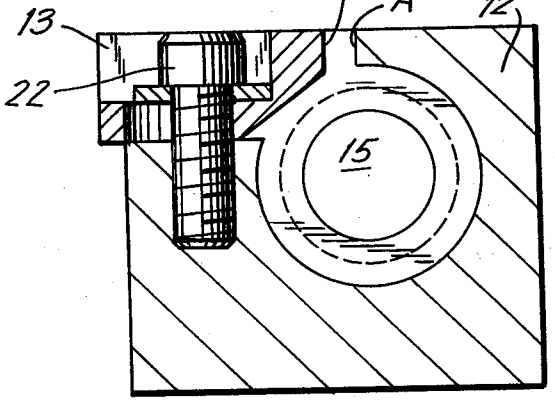
FIG. 5 is a cross sectional view similar to FIG. 4 showing a slot of maximum width formed in the device.
Figure 4:
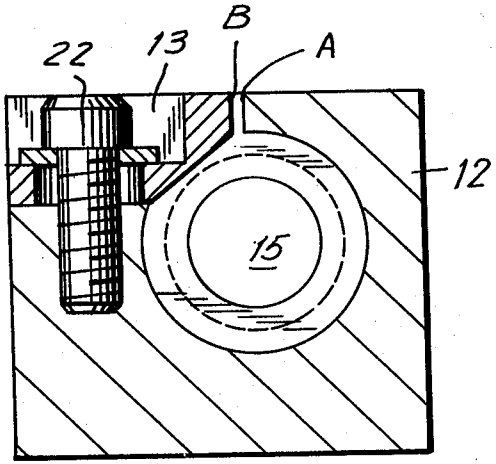
FIG. 4 is a cross sectional view of the device illustrated in FIG. 2 taken along lines 4—4 of FIG. 3 showing a slot of minimum width formed in the device.

In FIGS. 4 and 5, slot 14 is illustrated having its narrowest and widest widths, respectively. By moving slot adjuster 13 to various positions on body portion 12 prior to securing bolts 22 through openings 20 and 21, the width of slot 14 can be set as desired. Generally, in using the device of the present invention to produce a liquid curtain for fiber entanglement, it has been found that the slot width should be a maximum of about 0.050 inch.

Preferable is a width from about 0.003 to about 0.012 inch and most preferable is a width of about 0.005 inch.

As will be described in greater detail below, when a liquid under pressure is delivered from chamber 15 through slot 14 against a fiber batt, the liquid is in the form of a substantially non-diverging curtain. Generally, the width of the curtain will be dependent upon the width of slot 14.

With regard to the profile of slot 14, surface A of body portion 12 and surface B of slot adjuster 13 define slot 14, as shown in FIGS. 4 and 5. Also, as shown in FIGS. 4 and 5, surfaces A and B are essentially parallel to each other. It has been found however that slot profiles different than that of the device of FIGS. 1–5 can be utilized to provide a substantially non-diverging curtain. One may desire to impart particular characteristics, such as increased surface area, to a curtain produced by a device of the present invention. This can be accomplished by varying the profile of the slot through which the curtain is delivered.

Several slot profiles are illustrated in FIGS. *6a–6g* Profile b is essentially the same as the slot profile shown in FIGS. 4 and 5. The other profiles, *6a* and *6c–g*, are not formed by parallel surfaces, but like the slot profile of FIGS. 4 and 5 deliver a curtain having a substantially uniform width along the length of the slot.

It is contemplated that "uniform width" of the slot shall not mean only that the slot width at any point along its length is substantially constant, but more generally that a selected slot width can be maintained upon operation of the device, so that one portion of the slot does not unintentionally vary in width from other portions of the slot. Thus, the curtain delivered can similarly be uniform in width.

It is intended that slot profiles other than those described above be utilized in the present invention. For example, the profiles shown in FIGS. 7–9 are useful in delivering a substantially non-diverging curtain. Although these profiles exhibit a slot width which is not constant along the length of the slot, the slot width is uniform.

The slot profiles of FIGS. 7–9 are formed by surfaces A and B, where one or both surfaces are serrated. For instance, in FIG. 7, surface B is serrated, but the serrations are uniform along the length of the slot, so that a curtain delivered through the slot in the area of two similar serrations is substantially uniform and similar in width. Several different serrated slot profiles for providing serrated curtains are possible. The curtain delivered through the slot of FIG. 7 would be flat backed, whereas the curtain delivered through the slot of FIG. 8 could be characterized as a "square wave" or a constant width curtain described by a square wave function. In FIG. 9, the serrations of the slot defining surfaces are staggered. Several variations in each of these profiles is also possible, such as variation in size, shape and spaces of the serration. Also, the serrations may be cut into the slot defining surfaces at an angle or perpendicular to the longitudinal axis of members 12 and 13 which form the slot, depending upon the means used for cutting the serrations, such as thread cutters, photoengraving means, or other means for making the slot defining surfaces.

Referring to FIGS. 7 and 9, it is apparent that if the slot defining surfaces shown are brought together, then the slots shown in FIGS. 10 and 11 result. These slots would not be continuous, as is the case with the slots described above, but rather would be essentially separated jets or openings through which a plurality of needle jet streams could be delivered.

An advantage of this invention is that whatever slot profile is selected, the surface defining the slot can be machined accurately without undue difficulty; mainly because the slot is formed by two separate members that can each be separately machined, rather than by attempting to accurately machine a slot profile, such as shown in FIGS. *6a–6g*, in a single member. This would also hold true for other methods of making the slot defining surfaces, such as photoengraving. Also, the previously described means for securing together the members which define the slot insure that the machined surfaces will be rigid, essentially independent of the pressure under which the curtain is being delivered, so that the width of the slot and curtain being delivered remains unaffected.

It is further contemplated that many modifications may be made to the device described above without departing from the present invention. For example, the means provided for adjustably securing slot adjuster 13 to body portion 12 may be modified so that body portion 12 can be secured at various positions on slot adjuster 13, rather than the reverse as described above. Other means besides bolts 22 may be used to secure these members together, with the only requirement being that whatever means are selected, it should be capable of securing the members together so that the width of slot 14 formed therebetween is uniform along its length, even under the application of liquid delivered therethrough under a high pressure.

A second embodiment of the device of the present invention is illustrated in FIG. 12. The device shown is illustrated in place over a batt of fibers deposited upon a backing screen 23, only a top portion of which is shown. Preferably, the backing screen is apertured and generally will be in a movable relation with the liquid curtain being delivered from the device. As discussed below, the mesh and percent open area of backing screen 23 will affect the physical appearance of the entangled batt of fibers. As illustrative of suitable apertured backing screens are coarse, regular, or fine-wire plain weave screen ranging from 8 mesh to 80 mesh (wires per inch) having wire diameters ranging from 0.005 to 0.1 inch, and having from about 10 to about 70% open area. Preferably, the apertured backing screen will have from about 30–50% open area.

Again referring to the device shown in FIG. 12, liquid under pressure is delivered from a liquid source 24 through multiple pipes 25 into the upper section of the device rather than into its ends, as previously described with regard to the first device. The delivery of liquid through multiple pipes 25 into different areas of this device effects more even liquid pressure and flow along the length of the device when the length of the device is greater than about 12 inches. It should be noted that the pressure gauge, shown in FIG. 12, forms no part of this invention and that means other than the end caps 17 shown can be used for sealing the chamber of this second device.

As illustrated in FIG. 13, this device includes a first member or body portion 26 and a second member or slot adjuster 27, which upon being secured together define a slot therebetween. These members are shown secured together in FIG. 14 where a slot 28 defined between them is illustrated in solid line having its narrowest width and in dotted line having its widest width. Pipes 25 deliver liquid from source 24 into the upper section of body portion 26 through openings 29 defined in portion 26. The upper section of portion 26 is recessed, as illustrated in FIG. 13, to define a first chamber 30 (shown in FIG. 14) adapted to contain the liquid delivered therein from a liquid source through openings 29. Between chamber 30 and slot 28 are several secondary chambers 31 which are formed in part by body portion 26 and separated from but in communication with one another, thereby providing a tensioned frame member to prevent slot distortion. Upon being secured to body portion 26, slot adjuster 27 completes the formation of secondary chambers 31. Thus, when body portion 26 and slot adjuster 27 are secured together, pipes 25 deliver the liquid under pressure first into chamber 30, then through the several secondary chambers 31, after which the liquid is delivered through slot 28. The means for adjustably securing together slot adjuster 27 and body portion 26 are essentially the same as described above. As shown in FIG. 13, openings of a generally oval shape are provided in slot adjuster 27. Bolts 32 are inserted through these openings into openings (not shown) in body portion 26. The openings in slot adjuster 27 have a greater transverse length than bolts 32, so that the width of slot 28 can be varied as described above. In addition to the variations discussed above which can be made in the device of the present invention, it is contemplated that the means for introducing liquid under pressure into the device illustrated in FIG. 12 can be modified, such as for example, by decreasing or increasing the number of pipes 25 or by varying the structure of chambers 30 and 31.

At least one device described above is utilized in the process of the present invention for entangling the fibers in the fiber batt to form a non-woven fabric. Generally, the process include supporting the batt on backing screen 23 and applying a hydraulic curtain from at least one device against the batt, while backing screen 23 and the batt thereon are moving in relation to the device and curtain being delivered therefrom.

Devices may be placed not only above backing screen 23 but also below it, so that the curtain or curtains delivered against the batt may be applied against one or both faces of the batt. However, when a curtain is being applied from below the batt, a top screen should be placed over the batt to serve the same function as a backing screen. Preferably, an entangling device utilized in the process is spaced from about ¼ inch to about ¾ inch from the batt but the device may be spaced up to about 2 inches from the batt. The spacing of a device from the batt will somewhat depend upon the fabric character desired but generally should be as close as mechanically possible.

Although it is contemplated that the fiber batt could be supported on a stationary backing screen while the entangling device was moved in relation to the backing screen and batt, preferably, backing screen 23 moves at a linear speed up to about 1000 ft/min in relation to the entangling device and liquid curtain delivered therefrom.

The present invention contemplates the utilization of a curtain of liquid which is uniform in width throughout its length (i.e. the length of the slot from which it is delivered), and substantially non-diverging to cause uniform fiber entanglement in a batt of fibers. To produce such a liquid curtain, several factors must be considered. First, the liquid must be contained in the chamber of the device selected under a pressure sufficient to effect fiber entanglement. The pressure of the liquid should be at least about 200 p.s.i.g. which gives a fluid velocity of 192 ft/sec at the slot orifice. By securing the body portion and slot adjuster together as described above so that the width of the slot does not vary, then variation in the pressure in the chamber does not significantly change the width of the curtain at any point along the length of the slot. Thus, although the pressure may be varied to change the energy being applied to the batt, the degree of entanglement will not be uneven across the fiber batt. Secondly, the width of the curtain will be determined primarily by the width of the slot from which it is delivered. Preferably, the curtain will have a width of about 0.005 inch. Thirdly, the divergence of the curtain should be no more than 5°. Preferably, the curtain will have a divergence no greater than 3°. It has been found that a divergence of 4° is satisfactory when the curtain is delivered from a slot 0.005 inch under a pressure of 200 p.s.i.g. at a distance of ¾ inch from the batt. Important in the consideration of uniform fiber entanglement is the factor of uniform width of the slot along its entire length. Although it is contemplated that a slot could be formed having different widths along its length, the devices described above prevent the existence of an unintended condition of uneven slot width. The slot should be uniform along the length of the chamber in the device selected to the degree that uniform fiber entanglement is achieved. Substantial uniformity of slot width exists when the width deviates no more than 0.0005 inch. It is also to be understood that the machined surfaces of the body portion and slot adjuster in the selected device are rigid and preferably parallel, so that when the curtain is delivered through the slot under the pressure recited above, the width of the slot will not vary more than 10% from the width of the slot when no curtain is being delivered therethrough. Thus, the width of the curtain delivered from the slot will deviate no more than 10% throughout its length.

In addition to the application of the liquid curtain against the fiber batt under the above conditions, modifications of the process of the present invention are contemplated. For example, several curtains can be applied against the fibers of the batt, where they would be directed from above or below the batt, which could receive a number of repetitive treatments to result in a desired degree of entanglement. The curtains could be delivered under different pressures, so that the batt becomes more entangled as it moves through the entangling apparatus.

While the nature of the backing screen utilized will to some degree affect the degree of entanglement, it primarily influences the physical appearance of the fabric. A backing screen may be chosen having a particular arrangement of wires or having a particular percentage of open area, so that the curtain is deflected to various degrees as it strikes the support means. Also, a top screen, similar but not necessarily identical to the backing screen, may be utilized above the batt. Both the backing screen and optional top screen should be selected so as not to alter the characteristics of the curtain whereby it would become divergent or non-uniform.

Fabrics made by this invention preferably are characterized by uniformly, but lightly entangled fibers. Uniformity essentially means that throughout the fabric the fibers are entangled to the same degree. Lightly entangled essentially means that a repeated operation of the invention on a fabric previously made by the invention will produce a significant increase in fiber entanglement. Generally, in comparison with prior art fabrics, the making of these preferred fabrics will not necessitate a high degree of entanglement before entanglement is uniform throughout the fabric.

Modifications of the present invention will occur to those skilled in the art and are contemplated to be within the scope of this invention.

What is claimed is:

1. A device for applying a liquid against a batt of fibers to entangle the fibers, comprising:

a first member, having a recessed portion defining at least a major portion of a longitudinal chamber, adapted to contain a liquid delivered therein from a liquid supply source under a pressure sufficient to effect fiber entanglement upon application of the liquid from the device against the fiber batt, and having an integral first machined surface extending substantially the length of said chamber;

a second member, having a second machined surface extending substantially along its entire length and conforming to an open portion of said first member, to form with said first member said longitudinal chamber and a slot providing communication from said chamber to the exterior of the device; and means for securing together said first and second members, so that said first and second machined surfaces define said slot;

said first and second machined surfaces being essentially parallel and rigid, whereby a substantially non-diverging curtain of liquid can be delivered through said slot for application against the batt of fibers; and at least one of said first and second machined surfaces being serrated, the serrations being uniform along the length of said surfaces, so that the curtain delivered through said slot in the area of two similar serrations is substantially uniform and similar in width.

2. In combination, at least one device for applying a liquid curtain against a batt of fibers to entangle the fibers, an apertured backing screen supporting the batt of fibers, and means for moving the device and the screen relative to one another, said device comprising:

a first member, having a recessed portion defining at least a major portion of a longitudinal chamber, adapted to contain a liquid delivered therein from a liquid supply source under a pressure sufficient to effect fiber entanglement upon application of the liquid from the device against the fiber batt, and having an integral first machined surface extending substantially the length of said chamber;

a second member, having a second machined surface extending substantially along its entire length and conforming to an open portion of said first member, to form with said first member said longitudinal chamber and a slot providing communication from said chamber to the exterior of the device; and means for securing together said first and second members, so that said first and second machined surfaces define said slot and said slot has a substantially uniform width along the length of said chamber;

said first and second machined surfaces being essentially parallel and rigid, whereby a substantially non-diverging curtain of liquid of a substantially uniform width can be delivered through said slot for application against the batt of fibers.

3. The combination according to claim 2 wherein said chamber is adapted to contain the liquid under a pressure of at least about 200 p.s.i.g.

4. The combination according to claim 2 wherein said slot has a maximum width of about 0.05 inch.

5. The combination according to claim 2 wherein said slot has a width from about 0.003 to about 0.012 inch.

6. The combination according to claim 2 wherein the width of said slot deviates no more than 0.0005 inch throughout its length.

7. The combination according to claim 2 wherein said means for securing together said members are adjustable, so that the distance between said first machined surface and said second machined surface can be varied.

8. The combination according to claim 2 wherein said first member further comprises several secondary chambers adjacent to and in communication with said chamber through which liquid is delivered from said chamber to said slot.

9. The combination of claim 2 wherein said backing screen has from about 10 to about 70% open area.

10. The combination of claim 2 wherein said backing screen has about 50% open area.

11. The combination of claim 2 further comprising a top screen placed over the fiber batt.

12. The combination of claim 2 wherein said backing screen is moving at a maximum linear speed of about 1000 ft/min in relation to said device.

13. The combination of claim 2 wherein the device is spaced about ¼ inch to ¾ inch from the fiber batt.

14. a process of entangling the fibers in a fiber batt comprising supporting said batt on an apertured backing screen and applying at least one curtain of liquid against said batt, said batt and said backing screen being in a movable relation with said curtain, said curtain being substantially uniform in width throughout its length and substantially non-diverging as it is delivered from a source of liquid under pressure to cause entanglement of the fibers in said batt upon its application thereagainst.

15. The process of claim 14 wherein said backing screen and batt are moving at a maximum linear speed of about 1000 ft/min in relation to said curtain.

16. The process of claim 14 wherein said backing screen has from about 10 to about 70% open area.

17. The process of claim 14 wherein said curtain is applied against said batt at a distance from about ¼ to about 1½ inch.

18. The process of claim 14 wherein said pressure is at least about 200 p.s.i.g. which results in a jet velocity of about 192 ft/sec.

19. The process of claim 14 wherein said curtain has a width of from about 0.003 to about 0.012 inch. o 20. The process of claim 14 wherein said curtain has a maximum divergence of about 5°.

21. The process of claim 14 wherein said curtain is applied from above said batt and has about a 90° angle of incidence to said batt and said process further comprises covering said batt with a top screen.

22. The process of claim 14 wherein said curtain is applied from below said batt and has about a 90° angle of incidence to said batt and said process further comprises covering said batt with a top screen.

23. The process of claim 22 wherein said curtain is applied from above said batt and has about a 90° angle of incidence to said batt.

24. The process of claim 14 wherein said batt of fibers is formed into a non-woven fabric upon the application of said curtain thereagainst.

25. The process of claim 14 wherein the width of said curtain deviates no more than 10% throughout its length.

26. The process of claim 14 wherein said backing screen and batt are moving at a maximum linear speed of about 1000 ft/min in relation to said curtain; said backing screen has from about 30 to about 50% open area; said curtain is applied against said batt at a distance from about 0.75 to about 1 inch, has a width of about 0.005 inch, has a maximum divergence of about 4°, and has a width deviating no more than 0.0005 inch throughout its length; said pressure is at least about 200 p.s.i.g. which results in a jet velocity of about 192 ft/sec; and curtains are applied against both faces of said batt.

27. The process of claim 14 wherein said curtain is serrated.

* * * * *